US011208188B2

(12) United States Patent
Fishburn et al.

(10) Patent No.: US 11,208,188 B2
(45) Date of Patent: Dec. 28, 2021

(54) THRUSTER ARRANGEMENT FOR A BOAT

(71) Applicant: Polaris Industries Inc., Medina, MN (US)

(72) Inventors: Bradley R. Fishburn, Nappanee, IN (US); Blair A. Donat, Elkhart, IN (US); Gabriel A. Marshall, Three Rivers, MI (US); Michael J. Fuchs, Blaine, MN (US); Andrew C. Schmid, Brooklyn Park, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 16/889,272

(22) Filed: Jun. 1, 2020

(65) Prior Publication Data

US 2020/0385097 A1 Dec. 10, 2020

Related U.S. Application Data

(60) Provisional application No. 62/859,507, filed on Jun. 10, 2019.

(51) Int. Cl.

| | |
|---|---|
| ***B63H 11/02*** | (2006.01) |
| ***B63B 35/38*** | (2006.01) |
| *B63H 11/00* | (2006.01) |

(52) U.S. Cl.

CPC ..... *B63H 11/02* (2013.01); *B63B 35/38* (2013.01); *B63H 2011/008* (2013.01)

(58) Field of Classification Search

CPC ... B63H 11/00; B63H 11/02; B63H 2011/008; B63B 35/00; B63B 35/38

USPC ..... 114/151, 292; 440/38

See application file for complete search history.

(56) References Cited

U.S. PATENT DOCUMENTS

| | | | | |
|---|---|---|---|---|
| 5,259,331 | A | 11/1993 | Hagan | |
| 6,142,841 | A * | 11/2000 | Alexander, Jr | B63H 11/08 114/151 |
| 6,581,537 | B2 | 6/2003 | McBride | |
| 7,185,599 | B1 | 3/2007 | Griffiths | |
| 7,950,340 | B1 * | 5/2011 | Curtis | B63B 1/125 114/61.1 |
| 8,622,778 | B2 | 1/2014 | Tyers | |
| 9,108,710 | B1 | 8/2015 | McChesney | |
| 9,738,364 | B2 | 8/2017 | Abney | |
| 9,778,657 | B2 | 10/2017 | Tyers | |
| 10,281,917 | B2 | 5/2019 | Tyers | |
| 2002/0129410 | P1 | 9/2002 | Amorao et al. | |
| 2005/0272322 | A1 | 12/2005 | Mizuguchi | |

(Continued)

FOREIGN PATENT DOCUMENTS

| | | |
|---|---|---|
| KR | 10-2016-0006943 | 1/2016 |
| WO | 2016/166620 | 10/2016 |
| WO | 2019/081019 | 5/2019 |

OTHER PUBLICATIONS

International Search Report and Written Opinion issued by the International Searching Authority, dated Dec. 21, 2020, for International Patent Application No. PCT/US2020/052973; 17 pages.

(Continued)

*Primary Examiner* — Lars A Olson

(74) *Attorney, Agent, or Firm* — Faegre Drinker Biddle & Reath LLP

(57) ABSTRACT

A pontoon boat including a thruster system is disclosed.

20 Claims, 18 Drawing Sheets

(56) References Cited

U.S. PATENT DOCUMENTS

| | | | |
|---|---|---|---|
| 2006/0228959 | A1 | 10/2006 | Ruiz |
| 2017/0205829 | A1 | 7/2017 | Tyers |

OTHER PUBLICATIONS

Evinrude unveils $5,999 iDock joystick piloting system, Boating Industry, dated Jul. 10, 2017; 4 pages.

* cited by examiner

THRUSTER ARRANGEMENT FOR A BOAT

RELATED APPLICATION

This application claims the benefit of U.S. Provisional Application No. 62/859,507, titled THRUSTER ARRANGEMENT FOR A BOAT, filed Jun. 10, 2019, the entire disclosure of which is expressly incorporated by reference herein.

FIELD

The present disclosure relates to systems and methods to change position of a boat and in particular a thruster system to position the boat.

BACKGROUND

Pontoon and other types of multi-hull boats are known. It is known to include at least one outboard engine positioned at the stern of the boat to propel the boat through the water.

SUMMARY

In an exemplary embodiment of the present disclosure, a pontoon boat is provided. The pontoon boat comprising a plurality of pontoons, a deck supported by the plurality of pontoons, and a thruster system. The plurality of pontoons defining a port side envelope of the plurality of pontoons and a starboard side envelope of the plurality of pontoons. The deck having an outer perimeter. The thruster system including at least one water inlet in the plurality of pontoons and a plurality of water outlets in the plurality of pontoons. The plurality of water outlets being positioned within the outer deck perimeter and between the port side envelope of the plurality of pontoons and the starboard side envelope of the plurality of pontoons.

In an example thereof, the plurality of pontoons includes a port side pontoon, a starboard side pontoon, and a third pontoon positioned between the port side pontoon and the starboard side pontoon, each of the plurality of pontoons extending longitudinally under the deck. In a variation thereof, the at least one water inlet and the plurality of water outlets are provided in the third pontoon.

In another example thereof, the plurality of water outlets includes a port-bow outlet. In a further example thereof, the plurality of water outlets includes a port-stern outlet. In yet another example thereof, the plurality of water outlets includes a starboard-bow outlet. In still another example thereof, the plurality of water outlets includes a starboard-stern outlet.

In still another example, the thruster system further includes at least one fluid pump which pumps fluid from the at least one inlet towards at least one of the plurality of outlets.

In yet still another example, the pontoon boat further comprises an outboard motor positioned at a stern of the pontoon board.

In still a further example, a first one of the plurality of water outlets is directed in a port-bow direction and a second one of the plurality of water outlets is directed in a starboard-bow direction.

In yet still another example, a first one of the plurality of water outlets is directed in a port-bow direction and a second one of the plurality of water outlets is directed in a starboard-stern direction.

In yet still a further example, a first one of the plurality of water outlets is directed in a port-bow direction and a second one of the plurality of water outlets is directed in a port-stern direction.

In a still yet further example, a first one of the plurality of water outlets is directed in a port-stern direction and a second one of the plurality of water outlets is directed in a starboard-bow direction.

In a further still example, a first one of the plurality of water outlets is directed in a port-stern direction and a second one of the plurality of water outlets is directed in a starboard-stern direction.

In another still example, a first one of the plurality of water outlets is directed in a starboard-bow direction and a second one of the plurality of water outlets is directed in a starboard-stern direction.

In a further yet example, a first one of the plurality of water outlets is positionable in a plurality of directions. In a variation thereof, the first one of the plurality of water outlets is moveable between a first position corresponding to a port-bow direction and a second position corresponding to a port-stern direction. In another variation thereof, the first one of the plurality of water outlets is moveable between a first position corresponding to a starboard-bow direction and a second position corresponding to a starboard-stern direction.

In a further yet example, the plurality of pontoons includes a port side pontoon, a starboard side pontoon, and a third pontoon positioned between the port side pontoon and the starboard side pontoon, the at least one water inlet being positioned within the outer deck perimeter and between the port side envelope of the plurality of pontoons and the starboard side envelope of the plurality of pontoons. In a variation thereof, the at least one water inlet is positioned in the third pontoon.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DETAILED DESCRIPTION OF THE DRAWINGS

Figure 1:
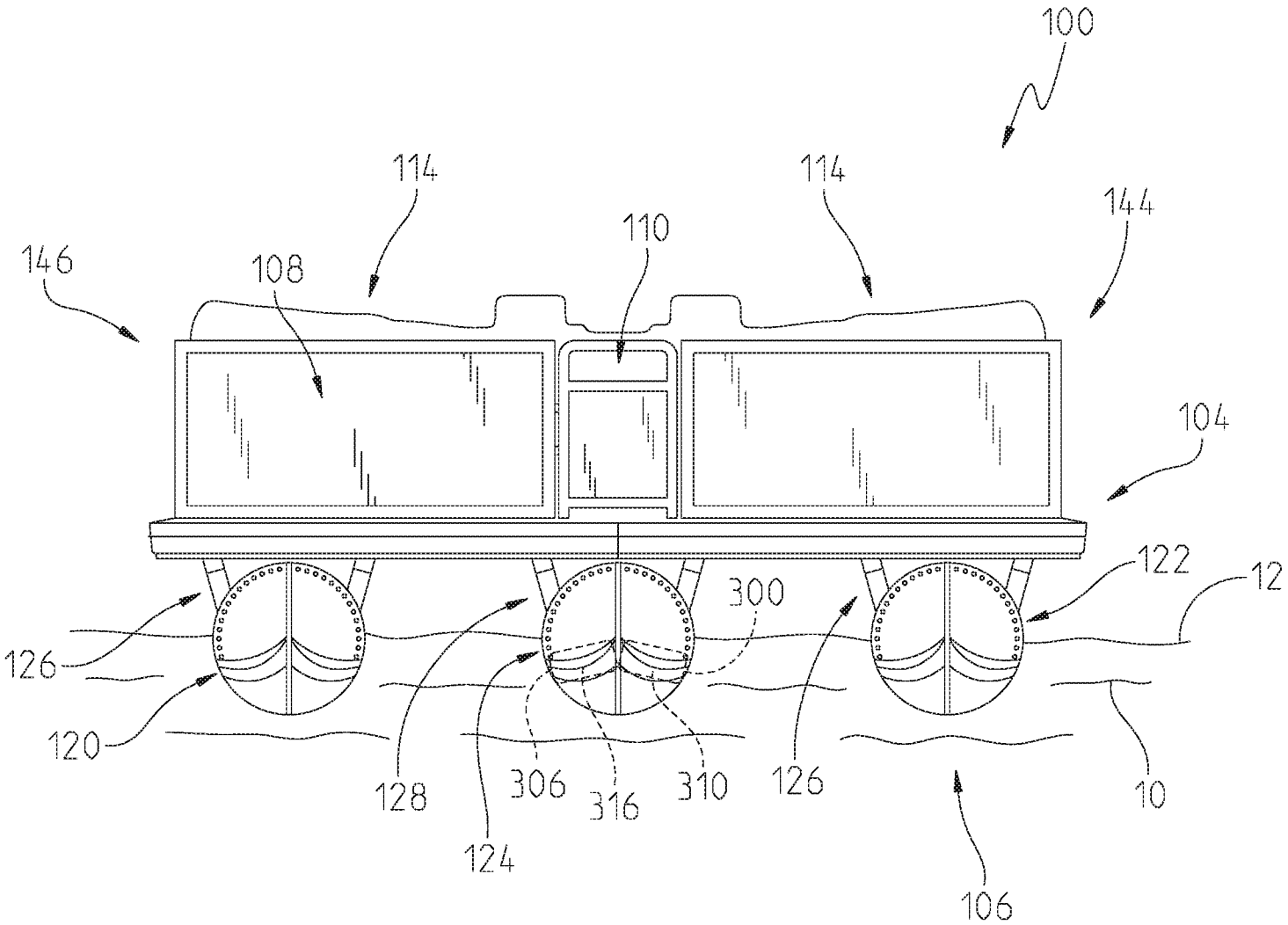
FIG. 1 illustrates a front view of a pontoon boat having a deck supported by a plurality of pontoons.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

Referring to FIG. 1, an exemplary pontoon boat 100 is floating in a body of water 10 having a top surface 12. Pontoon boat 100 includes a deck 104 supported by a plurality of pontoons 106. The deck supports a railing 108 including a gate 110 positioned in a bow portion 112 of pontoon boat 100. Pontoon boat 100 may further include a plurality of seats 114, a canopy (not shown), and other components supported by deck 104.

The plurality of pontoons 106 include a starboard pontoon 120, a port pontoon 122, and a central pontoon 124. Each of starboard pontoon 120, port pontoon 122, and central pontoon 124 support deck 104 through respective brackets 126. Each of starboard pontoon 120, port pontoon 122, and central pontoon 124 support deck 104 above top surface 12 of water 10. Although three pontoons are illustrated, the plurality of pontoons 106 may be limited to two pontoons or have four or more pontoons. Further, the thruster systems described herein may be used with a single hull vessel.

Figure 3:
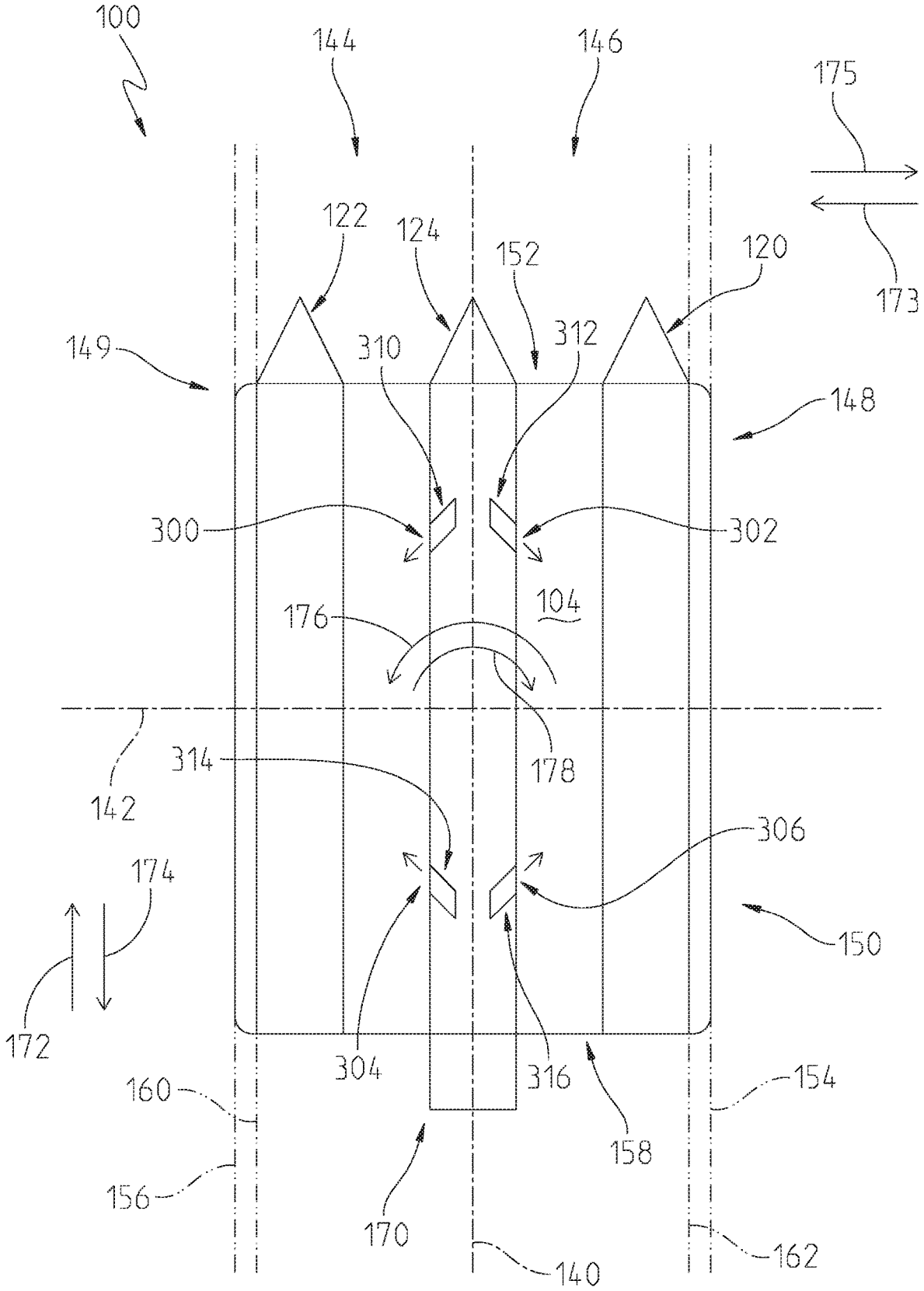
FIG. 3 illustrates a representative top view of the pontoon boat of FIG. 1 including a thruster system having a first group of thruster outlets positioned in a bow portion of the pontoon boat and directed towards the stern portion of the pontoon boat with a first one directed towards port and a second one directed towards starboard and a second group of thruster outlets positioned in a stern portion of the pontoon boat and directed towards the bow portion of the pontoon boat with a first one directed towards port and a second one directed towards starboard.

Referring to FIG. 3, pontoon boat 100 has a longitudinal centerline 140 and a lateral centerline 142. Longitudinal centerline 140 divides pontoon boat 100 into a port side 144 of pontoon boat 100 and a starboard side 146 of pontoon boat 100. Lateral centerline 142 divides pontoon boat 100 into a bow portion 148 of pontoon boat 100 and a stern portion 150 of pontoon boat 100. Deck 104 of pontoon boat 100 includes an outer perimeter 149 including a bow perimeter portion 152, a starboard perimeter portion 154, a stern perimeter portion 158, and a port perimeter portion 156. The plurality of pontoons 106 define a port extreme extent 160 corresponding to an outer extent of port pontoon 122 and a starboard extreme extent 162 corresponding to an outer extent of starboard pontoon 120.

Pontoon boat 100 includes an outboard motor 170 which extends beyond stern perimeter portion 158 of deck 104. In embodiments, outboard motor 170 is an internal combustion engine which power rotation of an impeller (not shown). The impeller may be rotated in a first direction to propel pontoon boat 100 forward in a direction 172 or in a second direction to propel pontoon boat 100 rearward in a direction 174. In embodiments, outboard motor 170 is rotatably mounted relative to deck 104 such that an orientation of the impeller may be adjusted to turn pontoon boat 100 in one of direction 176 and direction 178. In embodiments, multiple outboard motors 170 may be provided.

Figure 2:
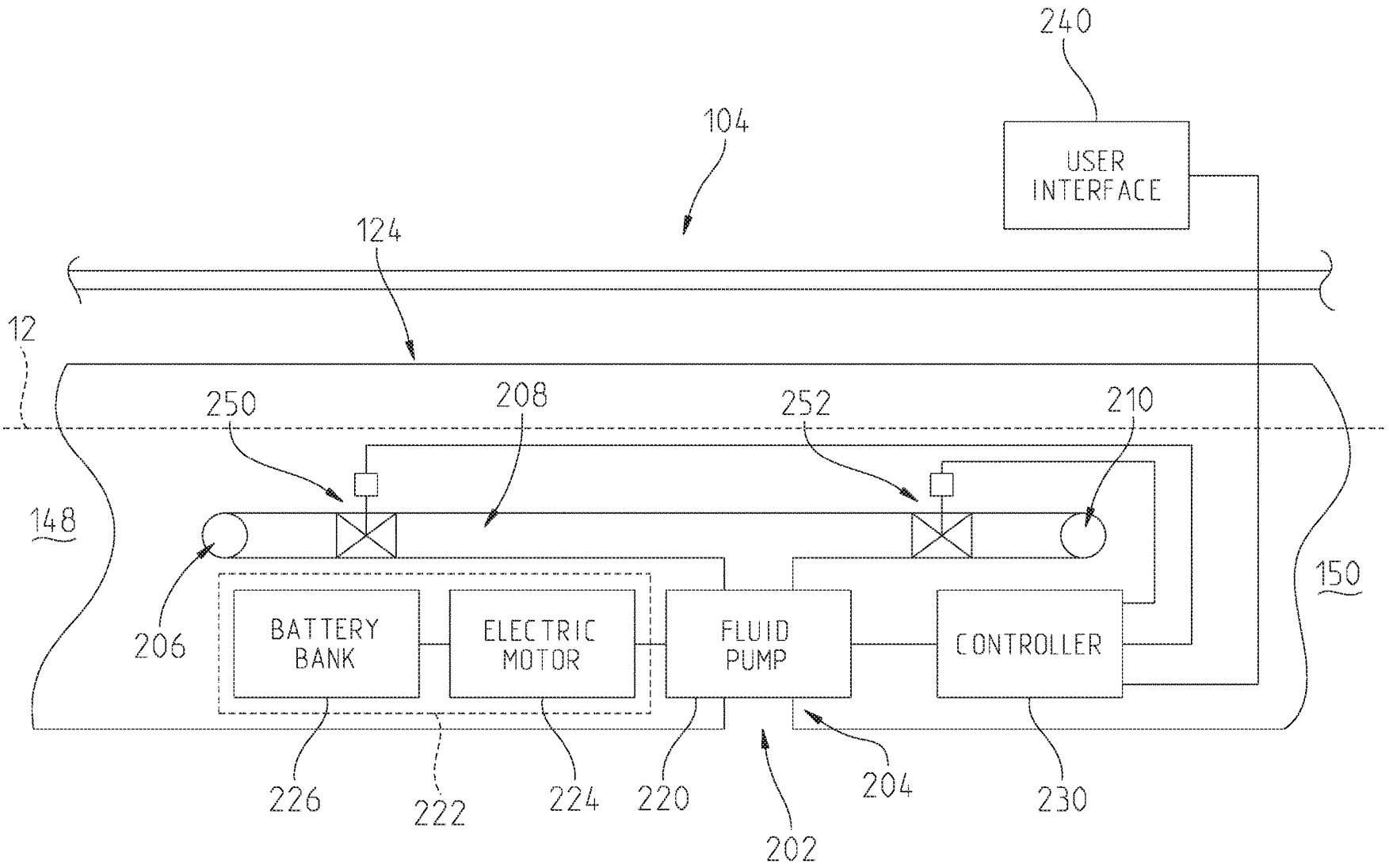
FIG. 2 illustrates a representative view of a portion of one of the plurality of pontoons including a thruster system.

Referring to FIG. 2, pontoon boat 100 further includes a thruster system 200. Thruster system 200 provides additional control over a position and/or orientation of pontoon boat 100. In embodiments, at least one of the plurality of pontoons 106, illustratively central pontoon 124, includes at least one water inlet, illustratively water inlet 202 of fluid conduit 204 is shown, and at least one water outlet, illustratively water outlet 206 and water outlet 210 both of fluid conduit 208, are shown. Fluid conduit 208 is fluidly coupled to fluid conduit 204. As shown in FIG. 2, each of water inlet 202, water outlet 206, and water outlet 210 are positioned below top surface 12 of water 10.

Thruster system 200 includes a fluid pump 220 positioned in fluid conduit 204 to move water from proximate water inlet 202 of fluid conduit 204 towards water outlet 206 and water outlet 210 of fluid conduit 208. Exemplary fluid pumps include the JT-30, JT-50, JT-70, and JT-90 series pumps available from Holland Marine Parts B.V. located at Donker Duyvisweg 297, 3316 BL Dordrecht (NL). Fluid pump 220 is powered by a power source 222. Illustratively power source 222 includes an electric motor 224 and a battery bank 226 which power electric motor 224.

The operation of fluid pump 220 is controlled with a controller 230. In embodiments, controller 230 is an electronic controller including processing circuits and memory. In embodiments, controller 230 is microprocessor-based and memory is a non-transitory computer readable medium which includes processing instructions stored therein that are executable by the microprocessor of controller to control operation of fluid pump 220. Exemplary non-transitory computer-readable mediums include random access memory (RAM), read-only memory (ROM), erasable programmable read-only memory (e.g., EPROM, EEPROM, or Flash memory), or any other tangible medium capable of storing information.

In embodiments, controller 230 is one of wired or wirelessly coupled to a user interface 240 positioned above deck 104. User interface 240 includes one or more input devices. Exemplary input devices 320 include switches, dials, joysticks, touch screens, and other suitable input devices for receiving a user input. In embodiments, user interface 240 is provided on a personal mobile device, such as a smart phone or tablet, and the personal mobile device includes processing instructions which provide input to controller 230 over a wireless connection.

As shown in FIG. 2, in embodiments, controller 230 is also operatively coupled to a first valve 250 and a second valve 252. Controller 230 controls whether fluid from fluid pump 220 reaches water outlet 206 based on whether first valve 250 is open or closed by controller 230. Controller 230 controls whether fluid from fluid pump 220 reaches water outlet 210 based on whether second valve 252 is open or closed by controller 230. In embodiments, controller 230 may control additional valves to control fluid flow to additional water outlets. In embodiments, thruster system 200 does not include valves 250 and 252. Rather, in one embodiment, fluid pump 220 is fluidly coupled to only water inlet 202 and water outlet 206 and a separate fluid pump 220 is provided to fluidly couple water inlet 202 and water outlet 210.

Referring to FIG. 3, an embodiment of thruster system 200 is illustrated. In FIG. 3, thruster system 200 includes four water outlets, a bow-port outlet 300, a bow-starboard outlet 302, a stern-port outlet 304, and a stern-starboard outlet 306. Bow-port outlet 300 has a corresponding fluid conduit 310 which causes water to exit bow-port outlet 300 in a direction, indicated by the arrow, towards both port side 144 of pontoon boat 100 and stern portion 150 of pontoon boat 100. Bow-starboard outlet 302 has a corresponding fluid conduit 312 which causes water to exit bow-starboard outlet 302 in a direction, indicated by the arrow, towards both starboard side 146 of pontoon boat 100 and stern portion 150 of pontoon boat 100. Stern-port outlet 304 has a corresponding fluid conduit 314 which causes water to exit stern-port outlet 304 in a direction, indicated by the arrow, towards both port side 144 of pontoon boat 100 and bow portion 148 of pontoon boat 100. Stern-starboard outlet 306 has a corresponding fluid conduit 316 which causes water to exit stern-starboard outlet 306 in a direction, indicated by the arrow, towards both starboard side 146 of pontoon boat 100 and bow portion 148 of pontoon boat 100.

In embodiments, each of fluid conduits 310-316 are angled downward (see FIG. 1). An advantage, among others, of angling the fluid conduits 310-316 downward is increased stability of pontoon boat 100 in water 10.

In embodiments, each of fluid conduit 310, fluid conduit 312, fluid conduit 314, and fluid conduit 316 are fed by a respective fluid pump 220 from one or more water inlets 202 in central pontoon 124. In embodiments, a plurality of fluid conduit 310, fluid conduit 312, fluid conduit 314, and fluid conduit 316 are fed by a common fluid pump 220 and one or more valves are included to control which of the plurality of fluid conduit 310, fluid conduit 312, fluid conduit 314, and fluid conduit 316 are in fluid communication with the common fluid pump 220.

Figure 4:
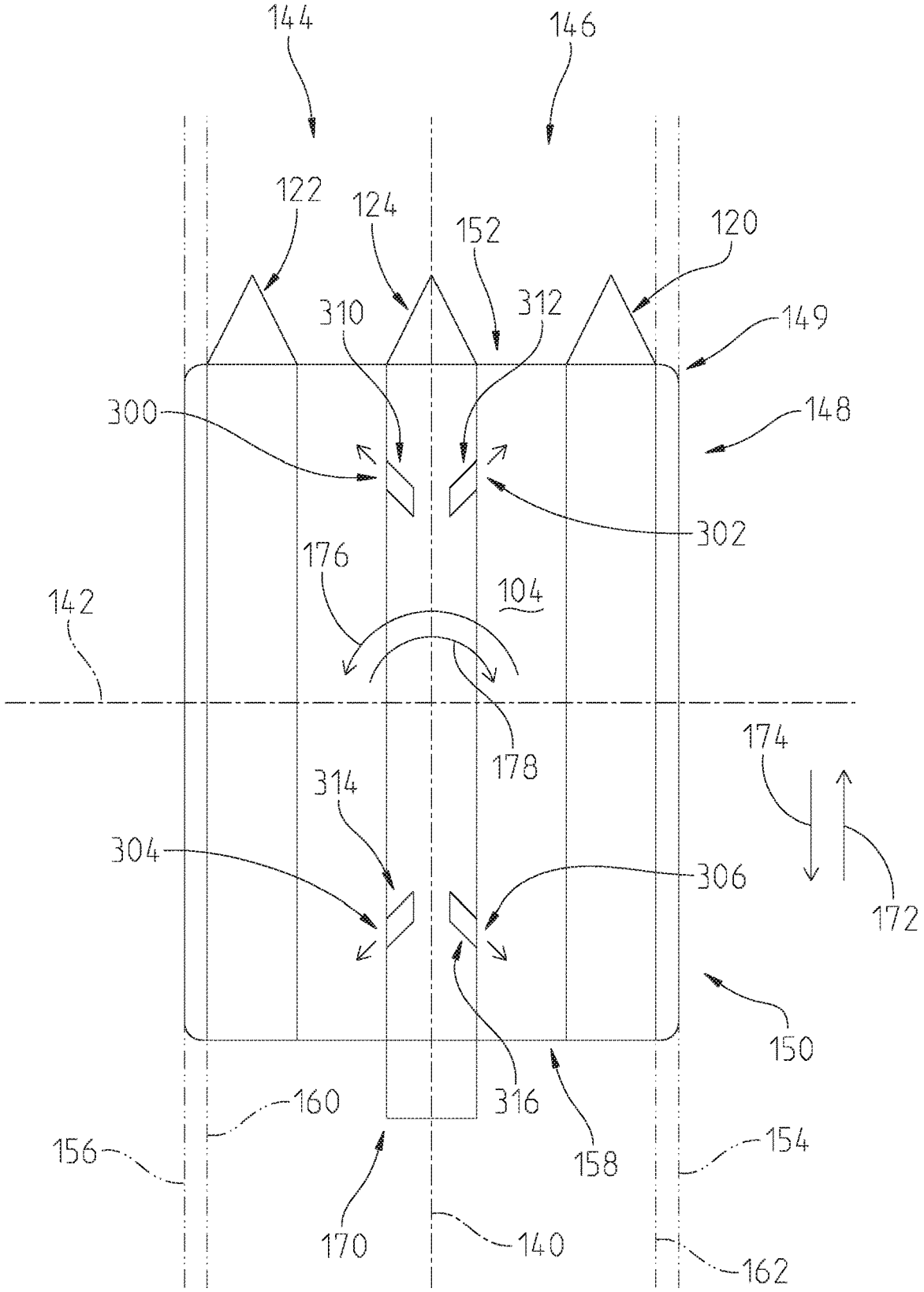
FIG. 4 illustrates a representative top view of the pontoon boat of FIG. 1 including a thruster system having a first group of thruster outlets positioned in a bow portion of the pontoon boat and directed towards the bow of the pontoon boat with a first one directed towards port and a second one directed towards starboard and a second group of thruster outlets positioned in a stern portion of the pontoon boat and directed towards the stern of the pontoon boat with a first one directed towards port and a second one directed towards starboard.

Referring to FIG. 4, another embodiment of thruster system 200 is illustrated. In FIG. 4, thruster system 200 includes water outlets 300-306 and corresponding fluid conduits 310-316. The embodiment of FIG. 4 differs from the embodiment of FIG. 3 based on the directions water exits the various ones of bow-port outlet 300, bow-starboard outlet 302, stern-port outlet 304, and stern-starboard outlet 306. Fluid conduit 310 corresponding to bow-port outlet 300 causes water to exit bow-port outlet 300 in a direction, indicated by the arrow, towards both port side 144 of pontoon boat 100 and bow portion 148 of pontoon boat 100. Fluid conduit 312 corresponding to bow-starboard outlet 302 causes water to exit bow-starboard outlet 302 in a direction, indicated by the arrow, towards both starboard side 146 of pontoon boat 100 and bow portion 148 of pontoon boat 100. Fluid conduit 314 corresponding to stern-port outlet 304 causes water to exit stern-port outlet 304 in a direction, indicated by the arrow, towards both port side 144 of pontoon boat 100 and stern portion 150 of pontoon boat 100. Fluid conduit 316 corresponding to stern-starboard outlet 306 causes water to exit stern-starboard outlet 306 in a direction, indicated by the arrow, towards both starboard side 146 of pontoon boat 100 and stern portion 150 of pontoon boat 100.

Figure 5:
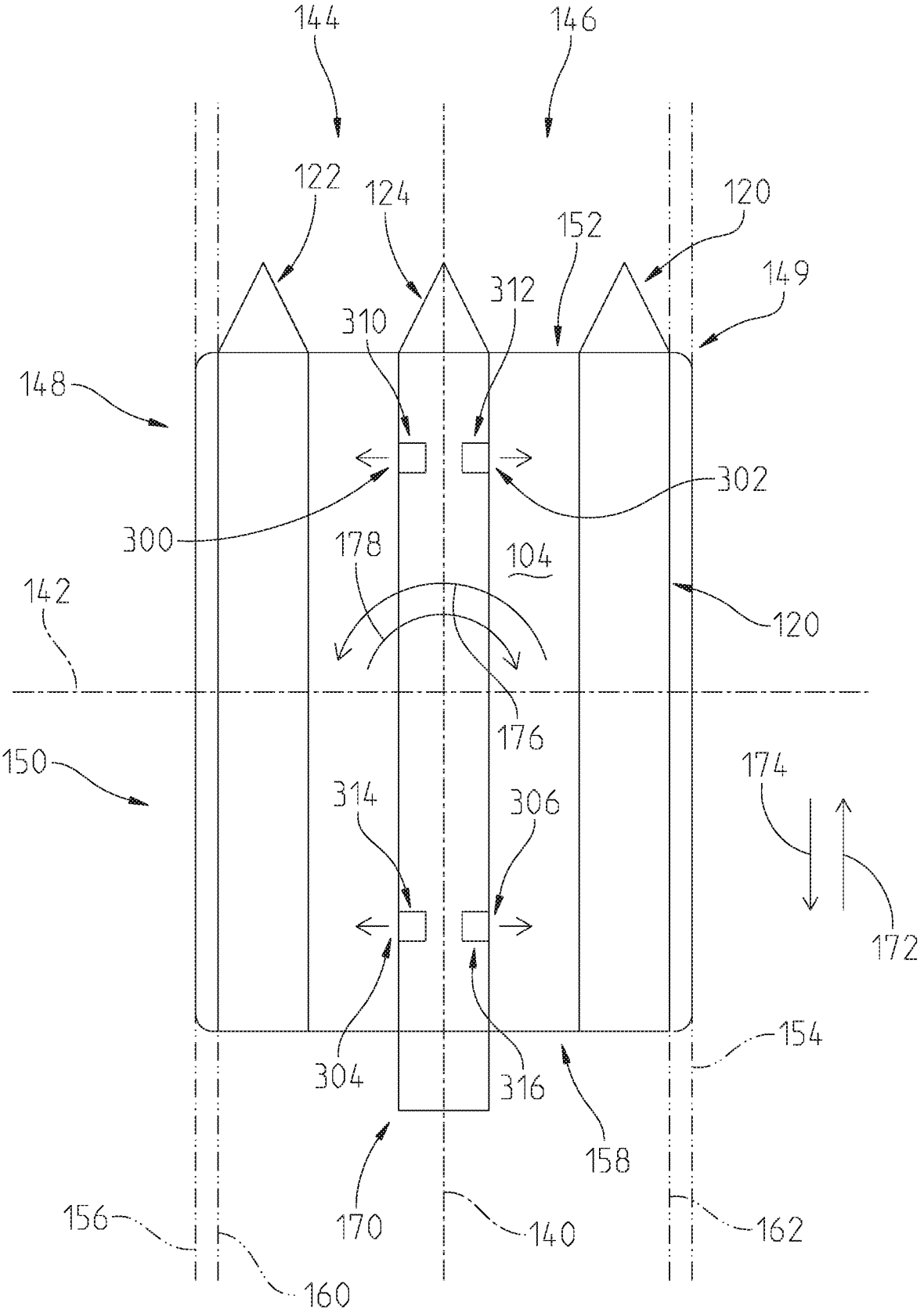
FIG. 5 illustrates a representative top view of the pontoon boat of FIG. 1 including a thruster system having a first group of thruster outlets positioned in a bow portion of the pontoon boat and with a first one directed towards port and a second one directed towards starboard and a second group of thruster outlets positioned in a stern portion of the pontoon boat and with a first one directed towards port and a second one directed towards starboard.

Referring to FIG. 5, another embodiment of thruster system 200 is illustrated. In FIG. 4, thruster system 200 includes water outlets 300-306 and corresponding fluid conduits 310-316. The embodiment of FIG. 5 differs from the embodiment of FIG. 3 based on the directions water exits the various ones of bow-port outlet 300, bow-starboard outlet 302, stern-port outlet 304, and stern-starboard outlet 306. Fluid conduit 310 corresponding to bow-port outlet 300 causes water to exit bow-port outlet 300 in a direction, indicated by the arrow, towards port side 144 of pontoon boat 100. Fluid conduit 312 corresponding to bow-starboard outlet 302 causes water to exit bow-starboard outlet 302 in a direction, indicated by the arrow, towards starboard side 146 of pontoon boat 100. Fluid conduit 314 corresponding to stern-port outlet 304 causes water to exit stern-port outlet 304 in a direction, indicated by the arrow, towards port side 144 of pontoon boat 100. Fluid conduit 316 corresponding to stern-starboard outlet 306 causes water to exit stern-starboard outlet 306 in a direction, indicated by the arrow, towards starboard side 146 of pontoon boat 100.

In the illustrated embodiment, thruster system 200 is associated with only central pontoon 124. In embodiments, thruster system 200 may have one or more water inlets and one or more water outlets with corresponding fluid pumps associated with one or both of starboard pontoon 120 and port pontoon 122. In embodiments, more or less water outlets may be provided on central pontoon 124 in bow portion 148 of pontoon boat 100, stern portion 150 of pontoon boat 100, on the port side 144 side of central pontoon 124, and/or on the starboard side 146 side of central pontoon 124.

Figure 6:
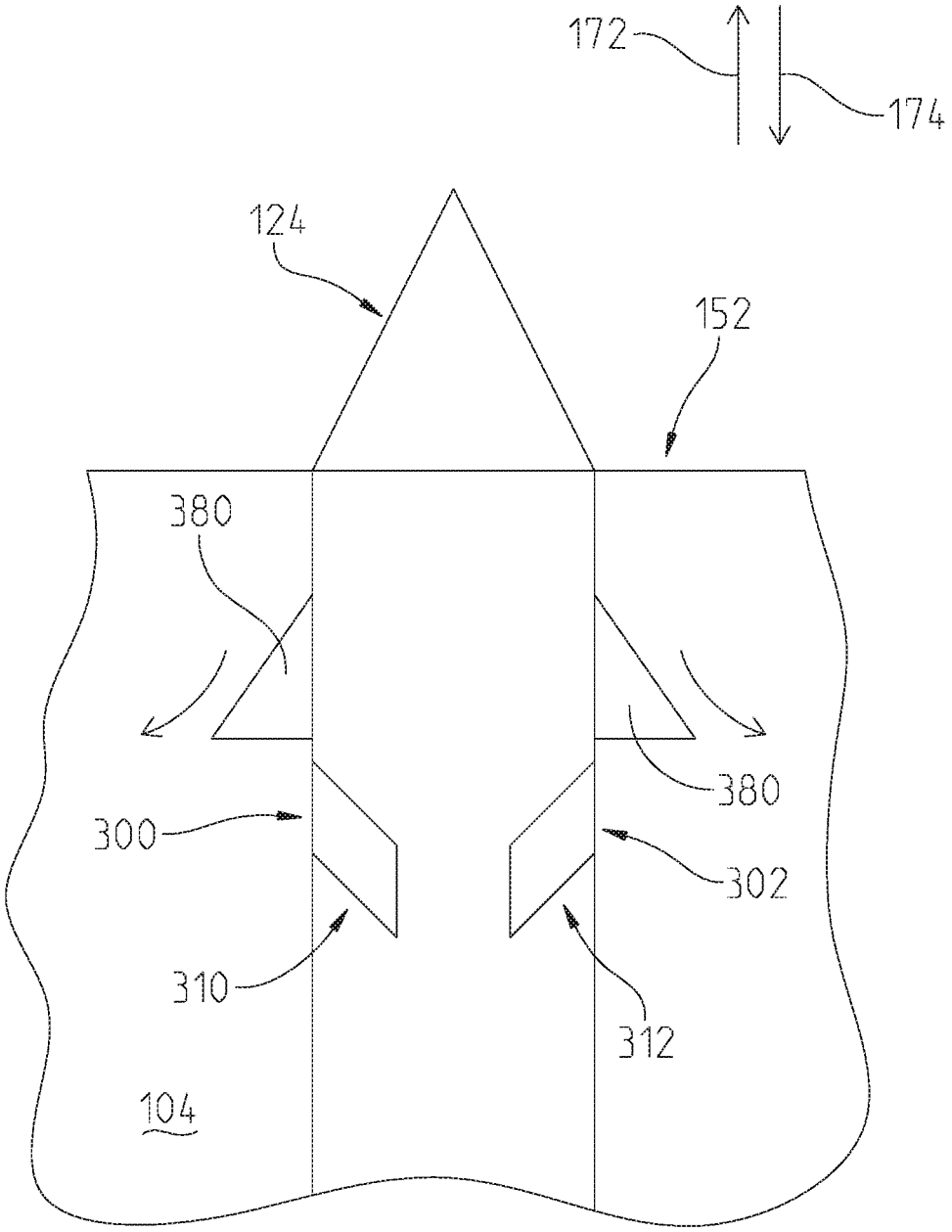
FIG. 6 illustrates a portion of the representative view of FIG. 4 with deflectors positioned proximate the outlets of the first group of thrusters.

Referring to FIG. 6, in embodiments, thruster system 200 further includes deflectors 380 supported by central pontoon 124. Deflectors 380 direct water away from bow-port outlet 300 and bow-starboard outlet 302 in the directions indicated by the arrows as pontoon boat 100 travels in forward direction 172.

In embodiments, one or more of fluid conduit 310, fluid conduit 312, fluid conduit 314, and fluid conduit 316 and thus the direction water generally exits the corresponding bow-port outlet 300, bow-starboard outlet 302, stern-port outlet 304, and stern-starboard outlet 306 is defined. In embodiments, one or more of fluid conduit 310, fluid conduit 312, fluid conduit 314, and fluid conduit 316 are moveable and thus the direction water generally exits the corresponding bow-port outlet 300, bow-starboard outlet 302, stern-port outlet 304, and stern-starboard outlet 306 may also be altered.

Figure 7A:
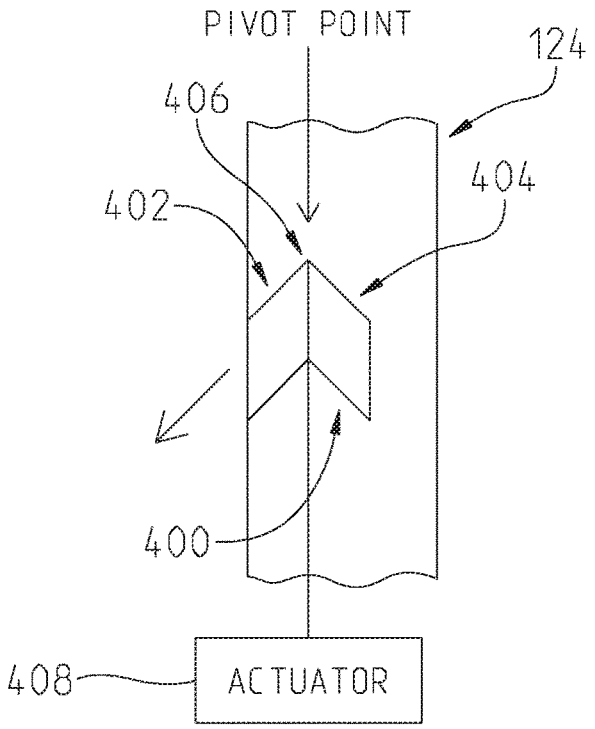
FIGS. 7A and 7B illustrates a representative view of a first thruster direction control system including an adjustable fluid conduit which is configurable to alter an output direction of the thruster system.
Figure 7B:
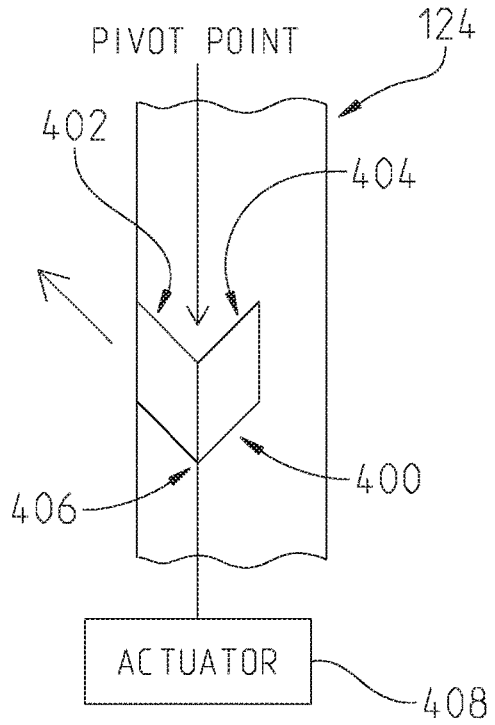
Figure 8:
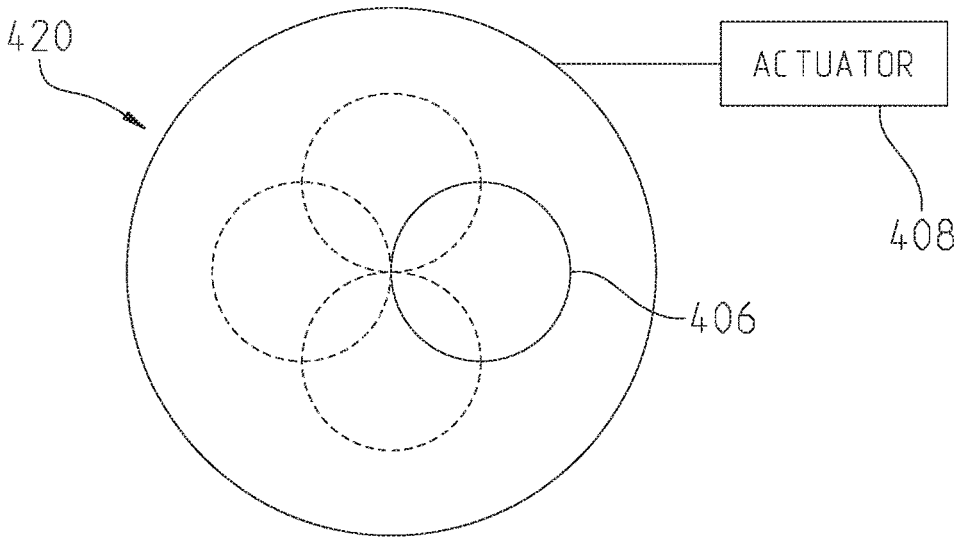
FIG. 8 illustrates an exemplary actuator for the adjustable fluid conduit of FIGS. 7A and 7B.

Referring to FIGS. 7A, 7B, and 8, one example of a movable fluid conduit is shown. Referring to FIGS. 7A and 7B, fluid conduit 400 includes first conduit portion 402 which terminates in fluid outlet 300 and a second conduit portion 404 which receives fluid from fluid pump 220 and is fluidly coupled to first conduit portion 402 to provide fluid to first conduit portion 402. First conduit portion 402 of fluid conduit 400 is coupled to second conduit portion 404 of fluid conduit 400 at a ring 406.

A position of ring 406 is controlled by an actuator 408. In a first position of ring 406, first conduit portion 402 directs water in the same direction as fluid conduit 310 in FIG. 3, as shown in FIG. 7A. In a second position of ring 406, first conduit portion 402 directs water in the same direction as fluid conduit 310 in FIG. 4, as shown in FIG. 7B. By having fluid conduit 400 be moveable, actuator 408 is able to provide both the embodiments depicted in FIGS. 3 and 4 with a single thruster system. Exemplary actuators 408 include linkages, gear trains, and other suitable actuation systems.

Referring to FIG. 8, an exemplary actuation system is shown. A wheel 420 includes an aperture which corresponds to ring 406. First conduit portion 402 of fluid conduit 400 and second conduit portion 404 of fluid conduit 400 are secured to the wall of the aperture forming ring 406. An actuator 408, such as a gear, rotates wheel 420 to position fluid conduit 400. In one embodiment, the position of ring 406 in FIG. 8 corresponds to the arrangement of fluid conduit 400 shown on the right side of FIG. 7. By rotating wheel 420 one-half revolution, ring 406 is positioned to correspond to the arrangement of fluid conduit 400 shown in the left side of FIG. 7.

Figure 9:
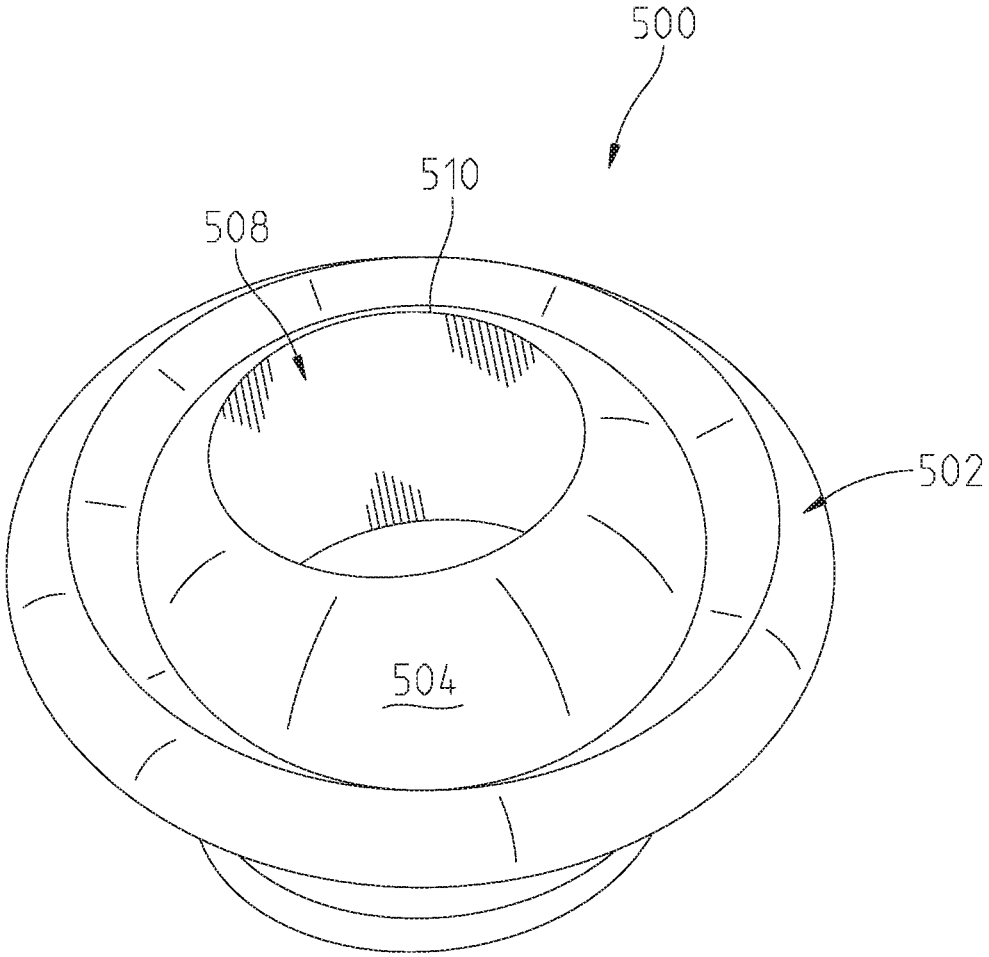
FIG. 9 illustrates a representative view of a second thruster direction control system including a ball member including a fluid conduit therethrough terminating in an outlet of the thruster system, the ball member being positionable by an actuator.

Referring to FIG. 9, another example of a moveable fluid conduit 500 is shown. Moveable fluid conduit 500 includes a base 502 which is coupled to central pontoon 124 and a ball member 504 which is rotatable relative to base 502. Ball member 504 includes a fluid passage 508 through which fluid can pass. In embodiments, fluid conduit 500 is coupled to central pontoon 124 and an outlet 510 of fluid passage 508 serves as a water outlet of thruster system 200.

Figure 12:
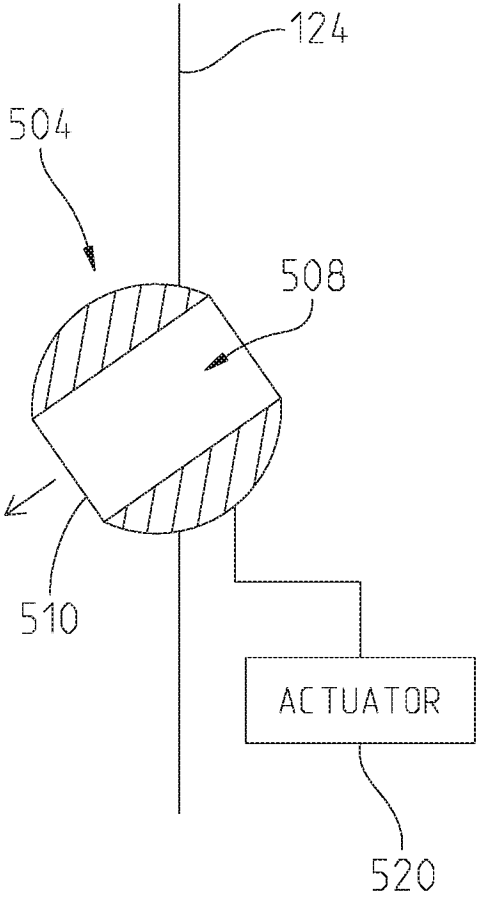
FIG. 12 illustrates the ball member in a third orientation orienting the outlet towards the stern of the pontoon boat and the port side of the pontoon boat.
Figure 11:
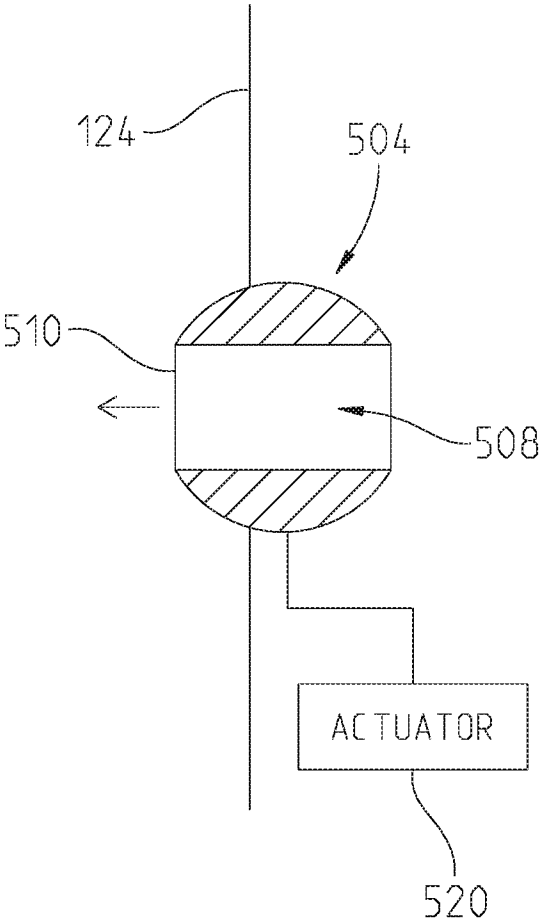
FIG. 11 illustrates the ball member in a second orientation orienting the outlet towards the port side of the pontoon boat.
Figure 10:
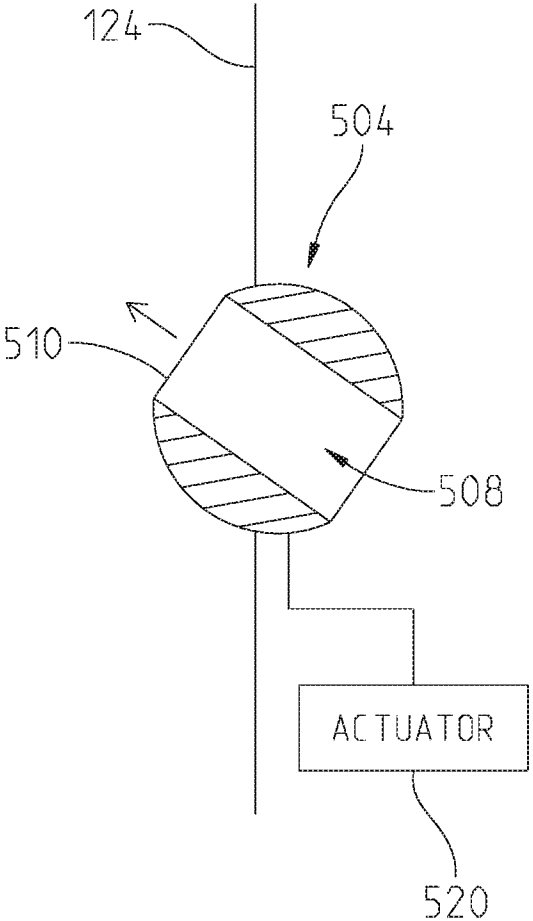
FIG. 10 illustrates the ball member in a first orientation orienting the outlet towards the bow of the pontoon boat and the port side of the pontoon boat.

Referring to FIGS. 10-12, ball member 504 is rotatable by an actuator 520 to alter a direction that water exits ball member 504, as indicated by the arrows. Assuming outlet 510 corresponds to bow-port outlet 300 in FIGS. 3-5, the position of ball member 504 in FIG. 10 results in outlet 510 directing water in the same direction as bow-port outlet 300 in FIG. 4, the position of ball member 504 in FIG. 11 results in outlet 510 directing water in the same direction as bow-port outlet 300 in FIG. 5, and the position of ball member 504 in FIG. 12 results in outlet 510 directing water in the same direction as bow-port outlet 300 in FIG. 3. Exemplary actuators include linkages, gear trains, and other suitable actuators.

Figure 13:
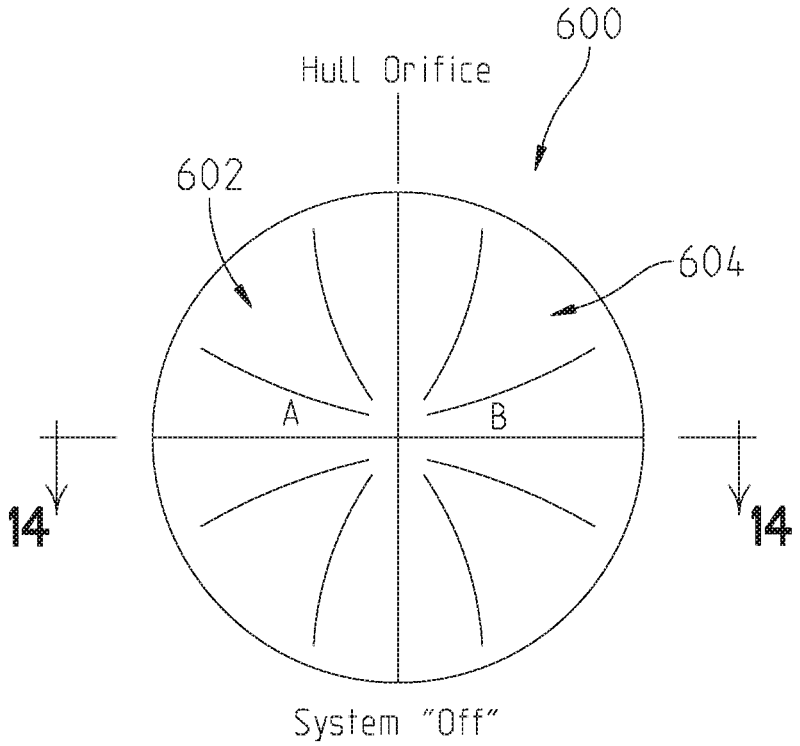
FIG. 13 illustrates a representative view of a third thruster control system including a plurality of deflectors positionable to change a direction of the thrust output, each of the plurality of deflectors being in a closed position.
Figure 14:
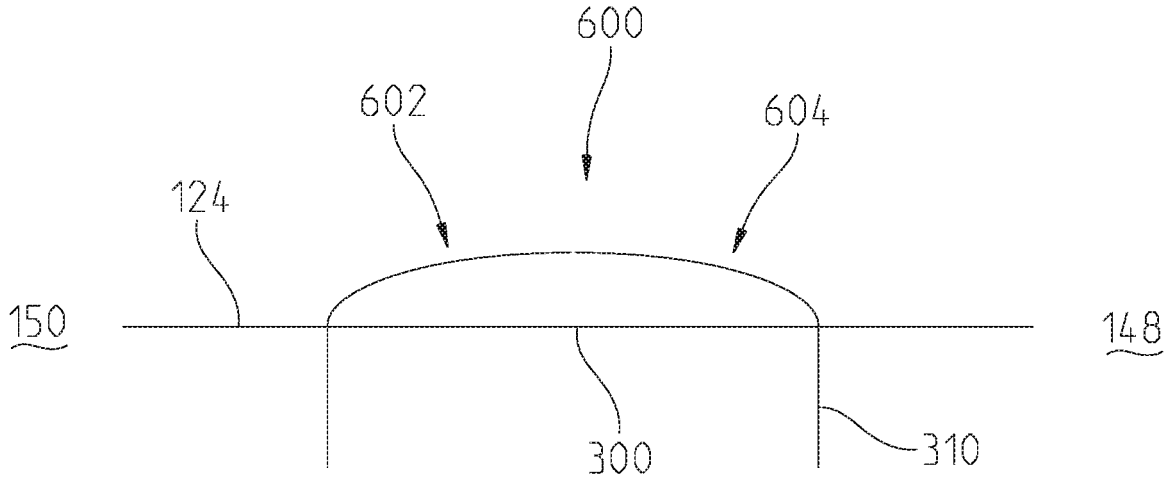
FIG. 14 illustrates a representative view along lines 14-14 in FIG. 13.
Figure 15:
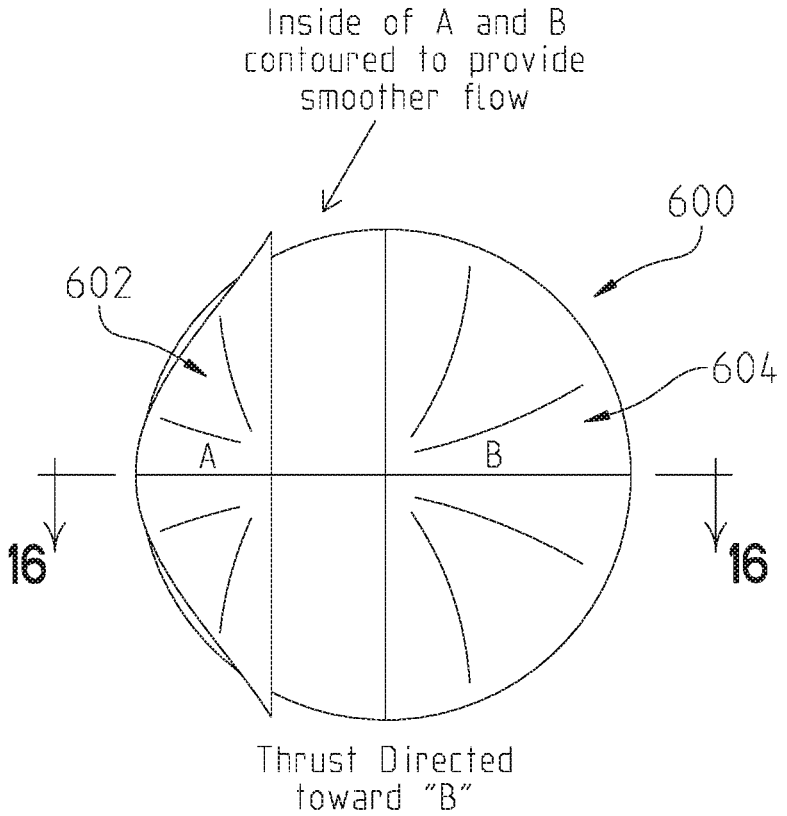
FIG. 15 illustrates a representative view of the thruster control system of FIG. 13 with a first deflector in an open position and a second deflector in a closed position resulting in the thrust output being directed towards the stern of the pontoon boat.
Figure 16:
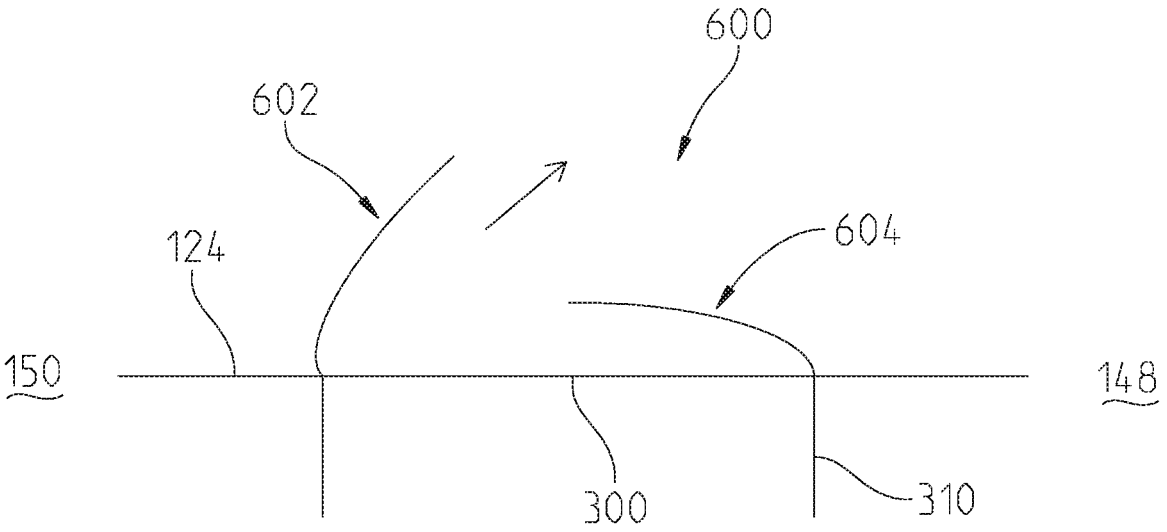
FIG. 16 illustrates a representative view along lines 16-16 in FIG. 15.

Referring to FIGS. 13-16, a cover 600 for bow-port outlet 300 is illustrated. Cover 600 covers bow-port outlet 300 when thruster system 200 is not in use. Additional covers 600 may be provided for the remaining outlets of thruster system 200. In the illustrated embodiment, cover 600 includes a first door 602 and a second door 604. Referring to FIGS. 13 and 14, cover 600 is shown in a closed position. Referring to FIGS. 15 and 16, cover 600 is shown in an open position wherein door 602 is opened to permit fluid to exit fluid conduit 310 through bow-port outlet 300 in the direction indicated by the arrow. As illustrated in FIG. 16, by having door 602 open, cover 600 approximates the arrangement of FIG. 4. If door 604 is opened and door 602 remains closed, cover 600 approximates the arrangement of FIG. 3. If both doors 602 and 604 are open, cover 600 approximates the arrangement of FIG. 5. The opening and closing of each of doors 602 and 604 may be controlled through an actuator. Exemplary actuators include linkages, gear trains, and other suitable actuation devices.

Figure 19:
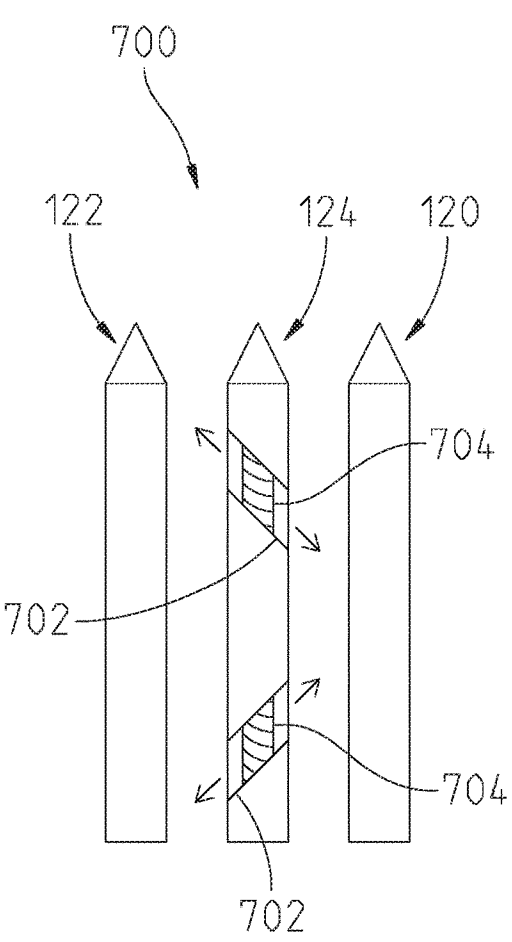
FIG. 19 illustrates a representative top view of the pontoon boat of FIG. 1 including another exemplary thruster system having a first reversible impeller and a second reversible impeller positioned in a pontoon of the pontoon boat.
Figure 18:
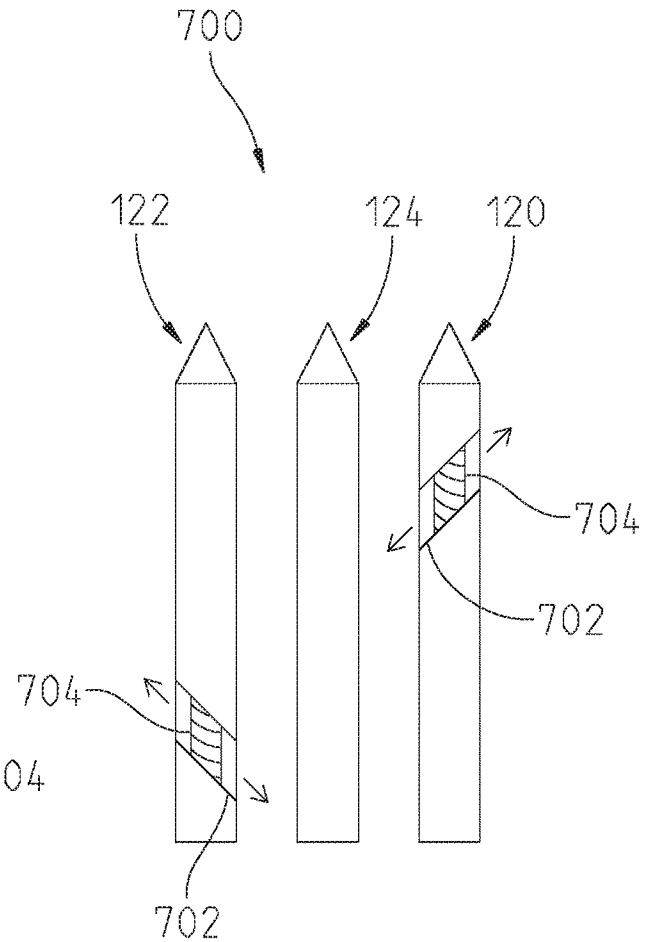
FIG. 18 illustrates a representative top view of the pontoon boat of FIG. 1 including another exemplary thruster system having a first reversible impeller positioned in a first pontoon of the pontoon boat and a second reversible impeller positioned in a second pontoon of the pontoon boat.
Figure 17:
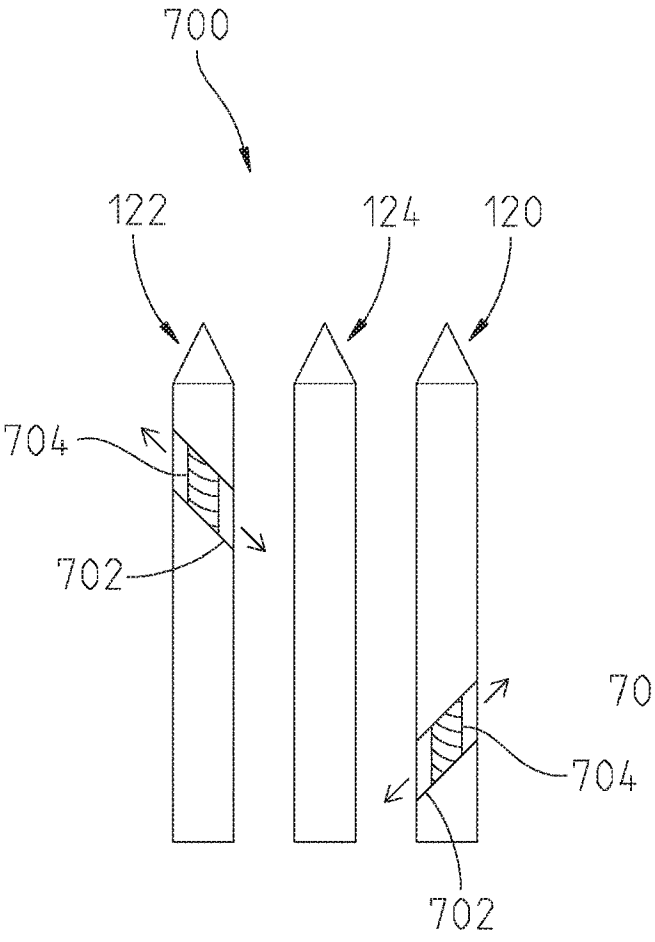
FIG. 17 illustrates a representative top view of the pontoon boat of FIG. 1 including another exemplary thruster system having a first reversible impeller positioned in a first pontoon of the pontoon boat and a second reversible impeller positioned in a second pontoon of the pontoon boat.

Referring to FIGS. 17-19, various arrangement of a thruster system 700 are shown. Each arrangement includes a plurality of fluid conduits 702 in respective pontoons 106. Positioned within each fluid conduit 702 is a reversible impeller 704 which may be rotated in a first direction to move water through the respective fluid conduit from a first opening in the pontoon towards a second opening in the pontoon and rotated in a second direction, opposite the first direction, through the respective fluid conduit from the second opening in the pontoon towards the first opening in the pontoon.

Figure 20B:
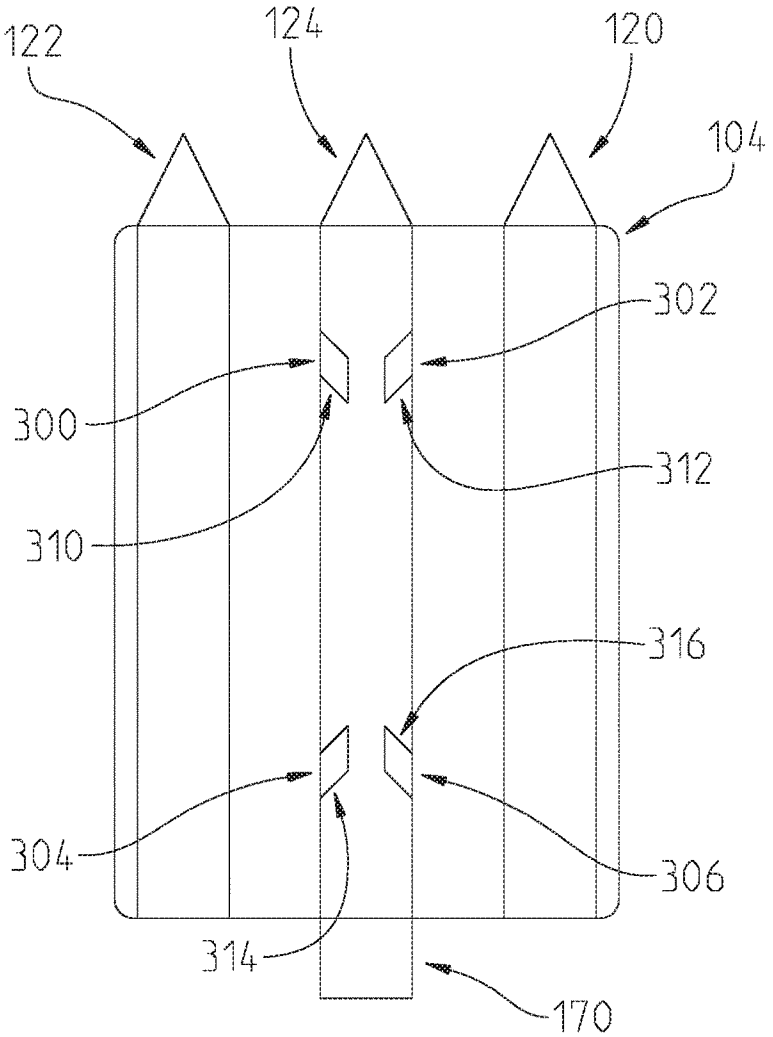
FIG. 20B illustrates the output of the thrust system of FIG. 4 corresponding to the position of the first user input device in FIG. 20A.
Figure 20A:
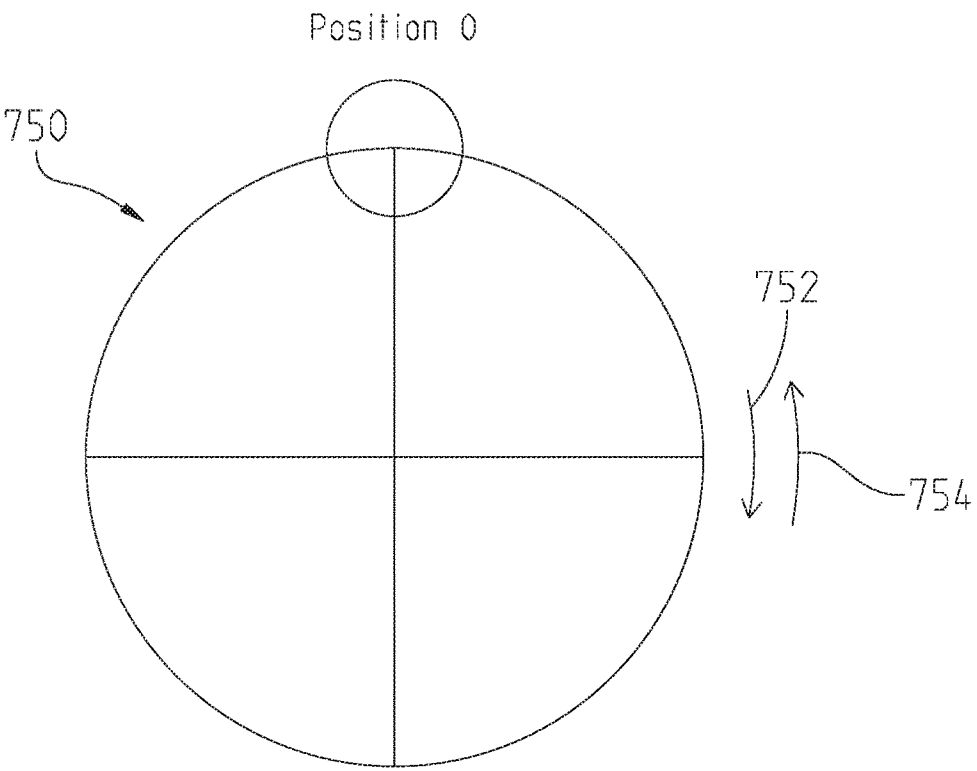
FIG. 20A illustrates a position of a first user input device, a dial controller, and the corresponding output of the thrust system of FIG. 4, as represented in FIG. 20B.

Referring to FIG. 20B, the arrangement of FIG. 4 is illustrated wherein no water is being pushed out of any one of bow-port outlet 300, bow-starboard outlet 302, stern-port outlet 304, and stern-starboard outlet 306 by thruster system 200. Referring to FIG. 20A, an exemplary input device, a rotatable dial 750, of user interface 240 is illustrated. Dial 750 is in an off position which provides an input to controller 230 to place thruster system 200 in the condition shown in FIG. 20B.

Figure 21B:
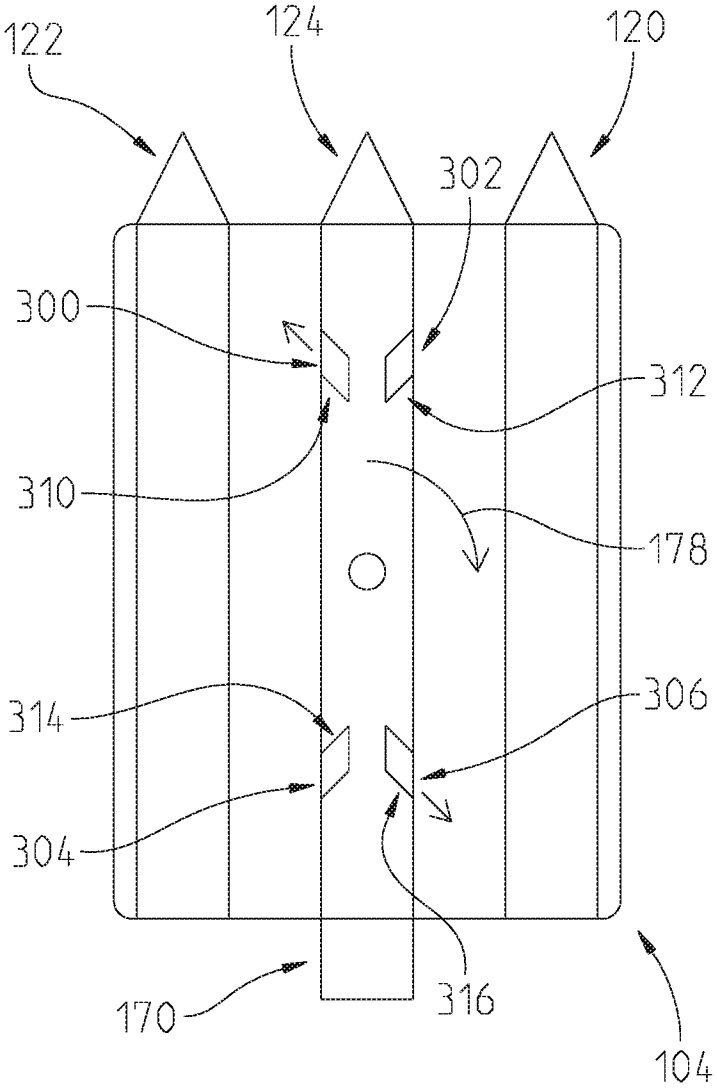
FIG. 21B illustrates the output of the thrust system of FIG. 4 corresponding to the position of the first user input device in FIG. 21A.
Figure 21A:
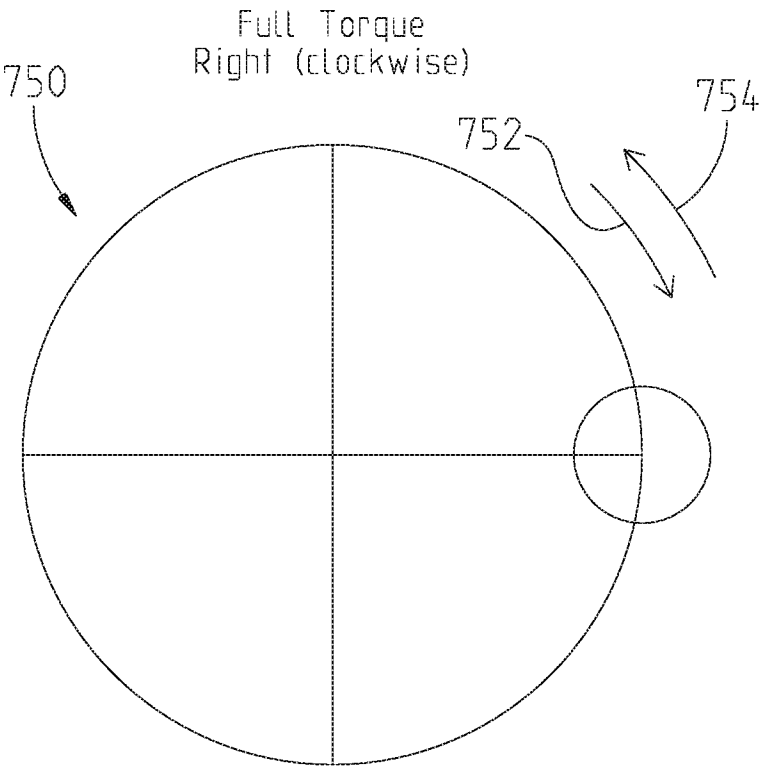
FIG. 21A illustrates a position of a first user input device, a dial controller, and the corresponding output of the thrust system of FIG. 4, as represented in FIG. 21B.

Referring to FIG. 21B, the arrangement of FIG. 4 is illustrated wherein water is being pushed out of bow-port outlet 300 and stern-starboard outlet 306 by thruster system 200 to rotate pontoon boat 100 clockwise in direction 178. Referring to FIG. 21A, dial 750 is in a full torque right position, rotated 90° in direction 752 from the off position of FIG. 20A, which provides an input to controller 230 to place thruster system 200 in the condition shown in FIG. 21B.

Figure 22B:
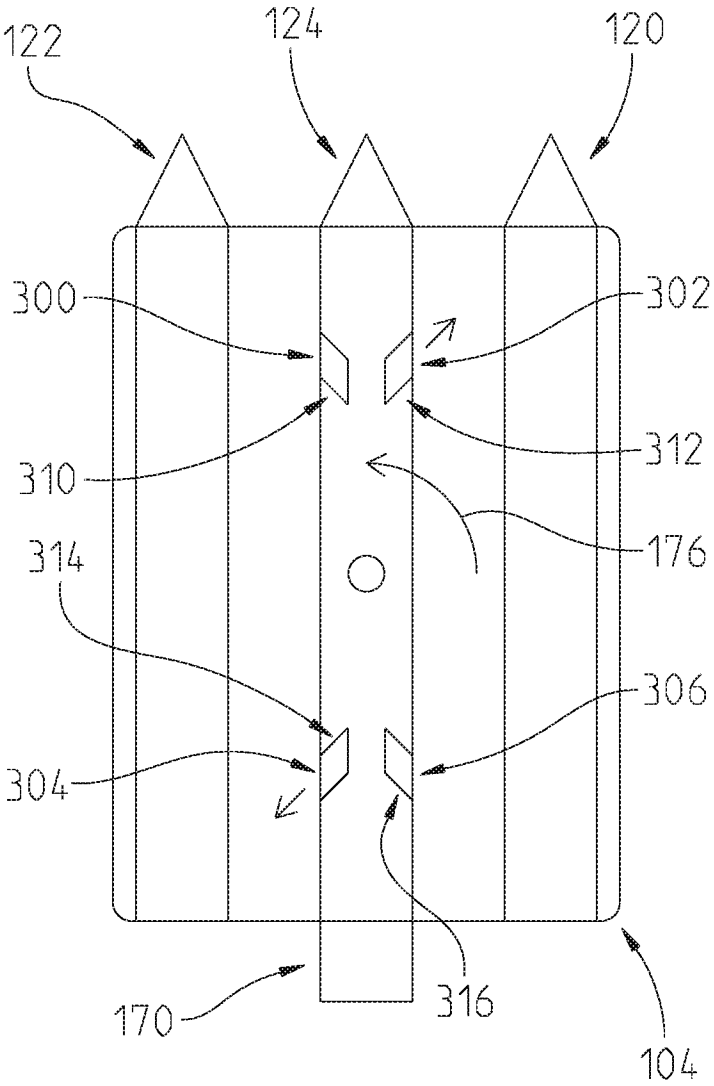
FIG. 22B illustrates the output of the thrust system of FIG. 4 corresponding to the position of the first user input device in FIG. 22A.
Figure 22A:
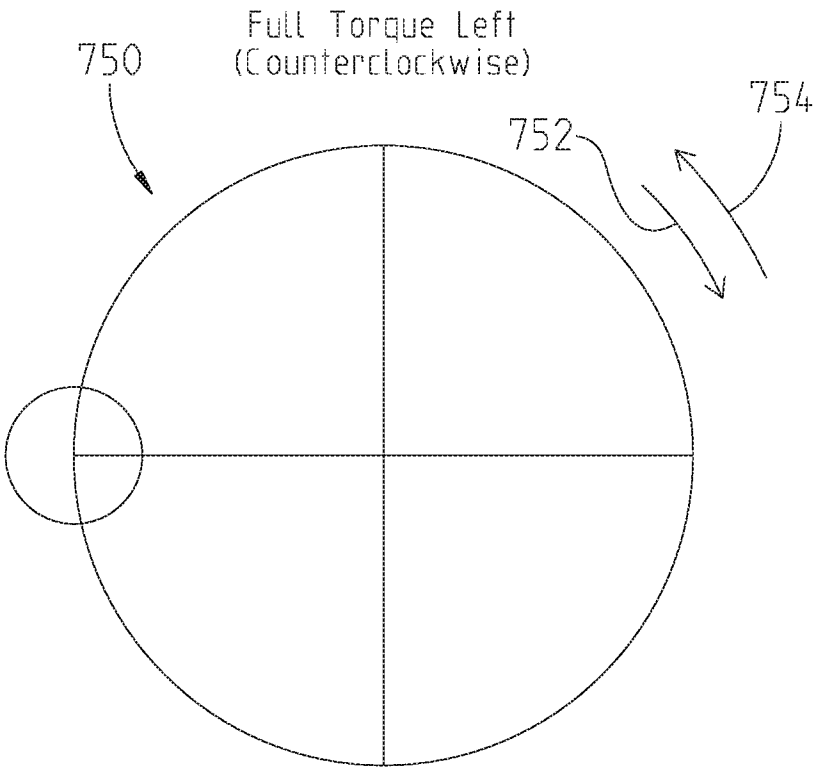
FIG. 22A illustrates a position of a first user input device, a dial controller, and the corresponding output of the thrust system of FIG. 4, as represented in FIG. 22B.
Figure 23:
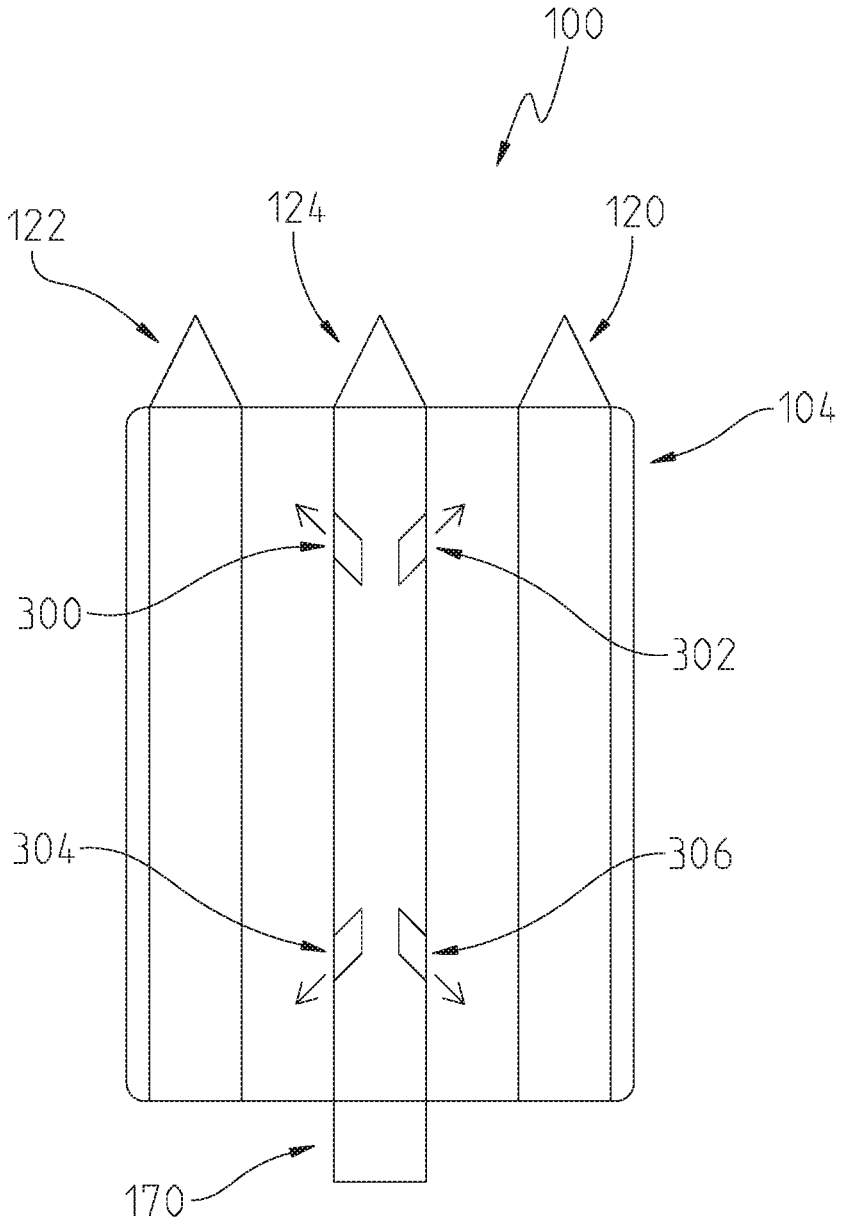
FIG. 23 illustrates the thrust system of FIG. 4.

Referring to FIG. 22B, the arrangement of FIG. 4 is illustrated wherein water is being pushed out of bow-starboard outlet 302 and stern-port outlet 304 by thruster system 200 to rotate pontoon boat 100 counterclockwise in direction 176. Referring to FIG. 22A, dial 750 is in a full torque left position, rotated 90° in direction 754 from the off position of FIG. 20A, which provides an input to controller 230 to place thruster system 200 in the condition shown in FIG. 21B.

An advantage, among others, for utilizing thruster system 200 to turn pontoon boat 100 is that thruster system 200 can execute a tighter turn than outboard motor 170 due to bow-port outlet 300, bow-starboard outlet 302, stern-port outlet 304, and stern-starboard outlet 306 being located within the perimeter 149 of deck 104. One or more of bow-port outlet 300, bow-starboard outlet 302, stern-port outlet 304, and stern-starboard outlet 306 may be used to move pontoon boat 100 forward in direction 172 (see FIG. 3), rearward in direction 174 (see FIG. 3), laterally towards port in direction 173 (see FIG. 3), laterally towards starboard in direction 175 (see FIG. 3), or combinations thereof.

Referring to FIGS. 24-27, an exemplary input device, a joystick 800, of user interface 240 is illustrated. Joystick 800 has a home position (its location illustrated in each of FIGS. 24-27). Joystick 800 is movable in any one of directions 802, 804, 806, and 808 or combinations thereof. The direction of movement provides an input to controller 230 of which outlets 300-306 of thruster system 200 should have water pushed out of and the magnitude of the displacement from the home position provides an input to controller 230 of the volume of water to be pushed out of the respective outlets 300-306.

Figure 24:
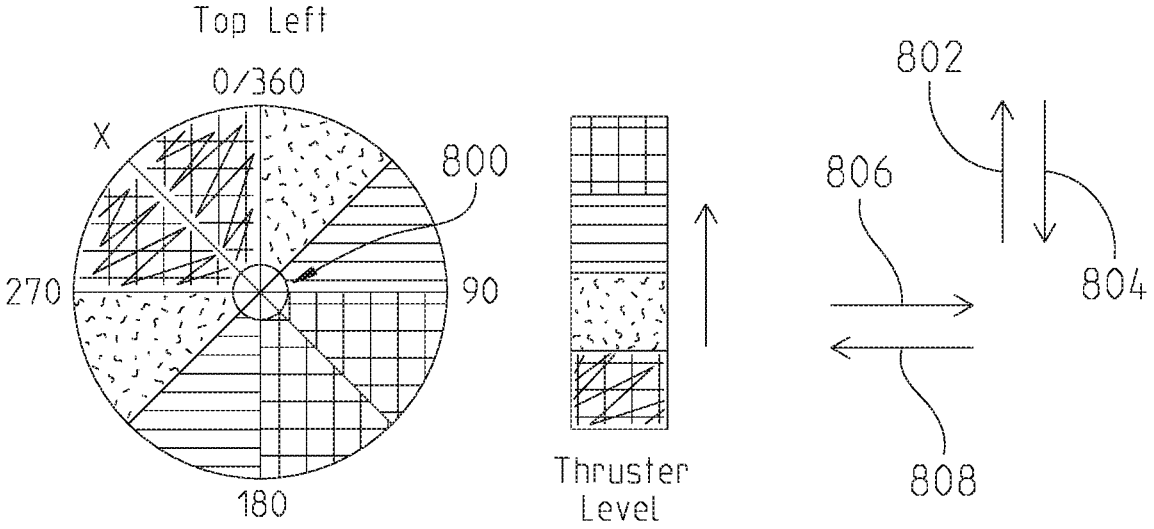
FIGS. 24-27 illustrate various positions of a second user input device, a joystick, and the corresponding thrust outputs for the thrust system of FIG. 23.

Referring to FIG. 24, joystick 800 is displaced to the location marked by "X". In this position, controller 230 pushes water out of stern-starboard outlet 306 at a first level, pushes water out of stern-port outlet 304 and bow-starboard outlet 302 at a second level less than the first level, and pushes no water out of bow-port outlet 300. The result is that pontoon boat 100 moves forward and towards port.

Figure 25:
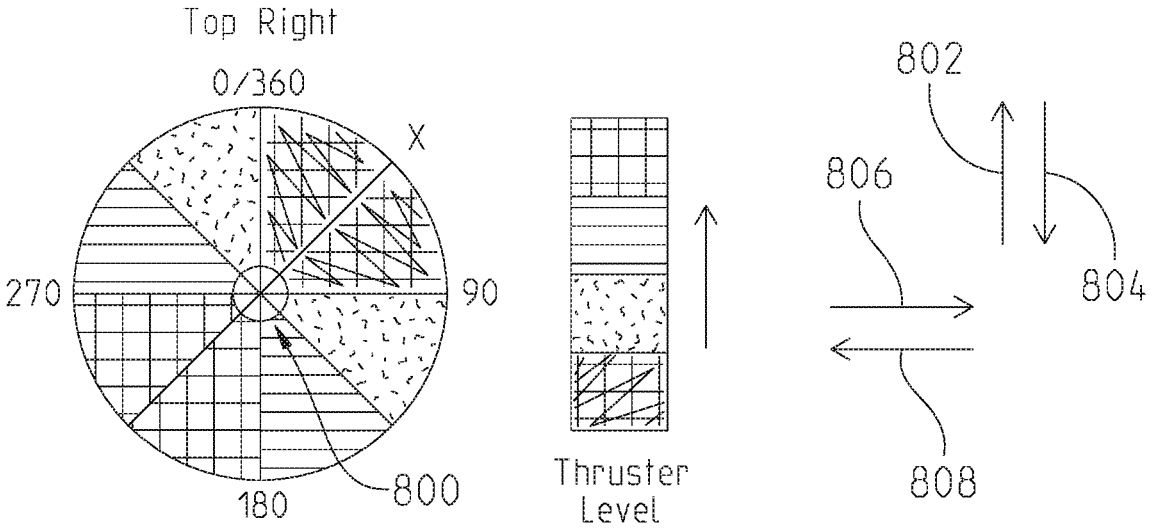

Referring to FIG. 25, joystick 800 is displaced to the location marked by "X". In this position, controller 230 pushes water out of stern-port outlet 304 at a first level, pushes water out of bow-port outlet 300 and stern-starboard outlet 306 at a second level less than the first level, and pushes no water out of bow-starboard outlet 302. The result is that pontoon boat 100 moves forward and towards starboard.

Figure 26:
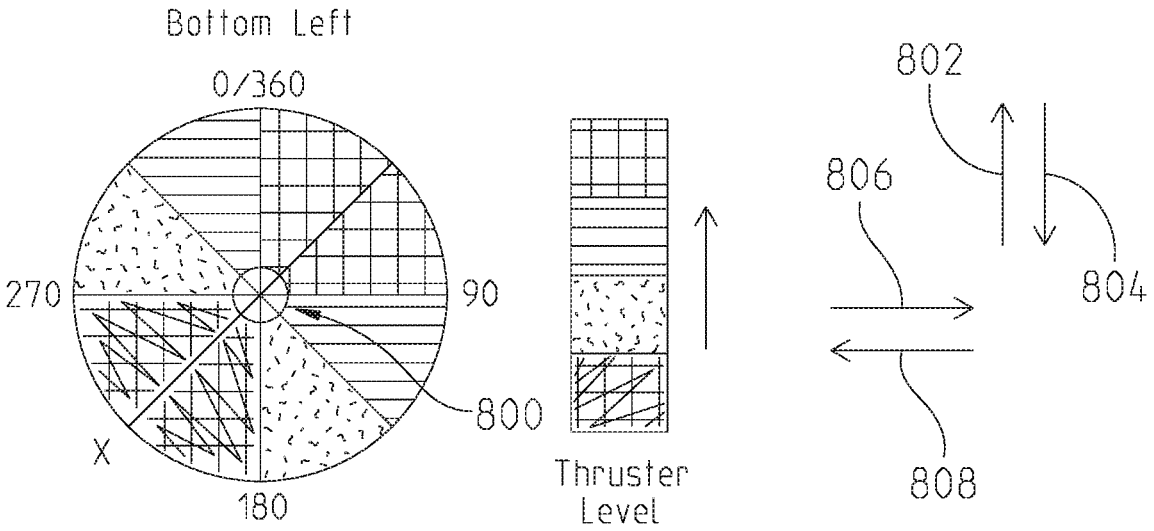

Referring to FIG. 26, joystick 800 is displaced to the location marked by "X". In this position, controller 230 pushes water out of bow-starboard outlet 302 at a first level, pushes water out of bow-port outlet 300 and stern-starboard outlet 306 at a second level less than the first level, and pushes no water out of stern-port outlet 304. The result is that pontoon boat 100 moves rearward and towards port.

Figure 27:
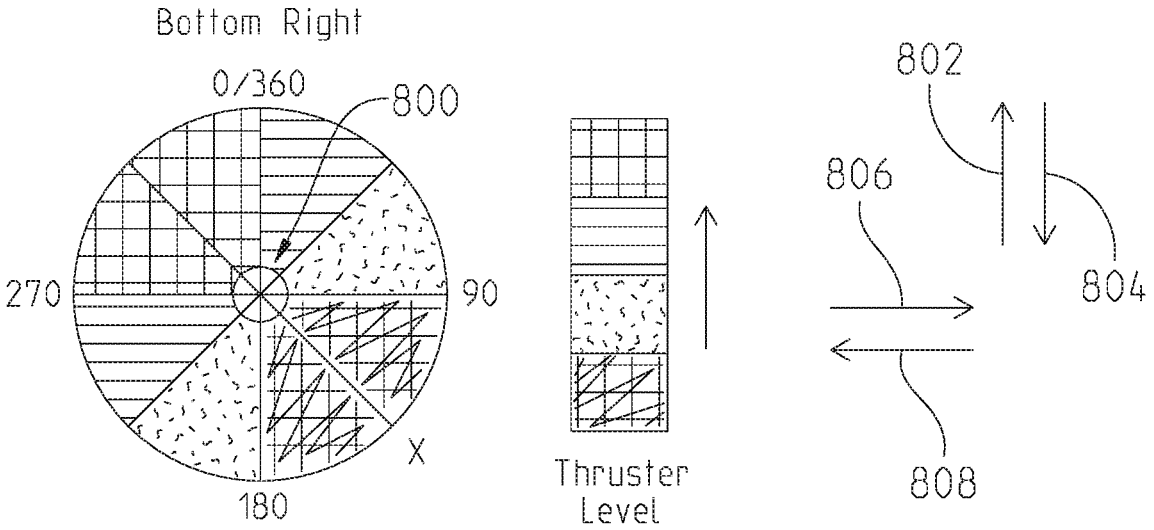

Referring to FIG. 27, joystick 800 is displaced to the location marked by "X". In this position, controller 230 pushes water out of bow-port outlet 300 at a first level, pushes water out of stern-port outlet 304 and bow-starboard outlet 302 at a second level less than the first level, and pushes no water out of stern-starboard outlet 306. The result is that pontoon boat 100 moves rearward and towards starboard.

In embodiments, the thruster systems described herein may be used in conjunction with an autonomous system to position or move the boat. Exemplary autonomous systems includes sensors to determine the surroundings of the boat and utilize the thruster systems to move the boat relative to the surroundings.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A pontoon boat, comprising:

a plurality of pontoons, the plurality of pontoons defining a port side envelope of the plurality of pontoons and a starboard side envelope of the plurality of pontoons;

a deck supported by the plurality of pontoons, the deck having an outer perimeter; and a thruster system including at least one water inlet in the plurality of pontoons and a plurality of water outlets in the plurality of pontoons, the plurality of water outlets being positioned within the outer deck perimeter and between the port side envelope of the plurality of pontoons and the starboard side envelope of the plurality of pontoons.

2. The pontoon boat of claim 1, wherein the plurality of pontoons includes a port side pontoon, a starboard side pontoon, and a third pontoon positioned between the port side pontoon and the starboard side pontoon, each of the plurality of pontoons extending longitudinally under the deck.

3. The pontoon boat of claim 2, wherein the at least one water inlet and the plurality of water outlets are provided in the third pontoon.

4. The pontoon boat of claim 1, wherein the plurality of water outlets includes a port-bow outlet.

5. The pontoon boat of claim 1, wherein the plurality of water outlets includes a port-stern outlet.

6. The pontoon boat of claim 1, wherein the plurality of water outlets includes a starboard-bow outlet.

7. The pontoon boat of claim 1, wherein the plurality of water outlets includes a starboard-stern outlet.

8. The pontoon boat of claim 1, wherein the thruster system further includes at least one fluid pump which pumps fluid from the at least one inlet towards at least one of the plurality of outlets.

9. The pontoon boat of claim 1, further comprising an outboard motor positioned at a stern of the pontoon boat.

10. The pontoon boat of claim 1, wherein a first one of the plurality of water outlets is directed in a port-bow direction and a second one of the plurality of water outlets is directed in a starboard-bow direction.

11. The pontoon boat of claim 1, wherein a first one of the plurality of water outlets is directed in a port-bow direction and a second one of the plurality of water outlets is directed in a starboard-stern direction.

12. The pontoon boat of claim 1, wherein a first one of the plurality of water outlets is directed in a port-bow direction and a second one of the plurality of water outlets is directed in a port-stern direction.

13. The pontoon boat of claim 1, wherein a first one of the plurality of water outlets is directed in a port-stern direction and a second one of the plurality of water outlets is directed in a starboard-bow direction.

14. The pontoon boat of claim 1, wherein a first one of the plurality of water outlets is directed in a port-stern direction and a second one of the plurality of water outlets is directed in a starboard-stern direction.

15. The pontoon boat of claim 1, wherein a first one of the plurality of water outlets is directed in a starboard-bow direction and a second one of the plurality of water outlets is directed in a starboard-stern direction.

16. The pontoon boat of claim 1, wherein a first one of the plurality of water outlets is positionable in a plurality of directions.

17. The pontoon boat of claim 16, wherein the first one of the plurality of water outlets is moveable between a first position corresponding to a port-bow direction and a second position corresponding to a port-stern direction.

18. The pontoon boat of claim 16, wherein the first one of the plurality of water outlets is moveable between a first position corresponding to a starboard-bow direction and a second position corresponding to a starboard-stern direction.

19. The pontoon boat of claim 1, wherein the plurality of pontoons includes a port side pontoon, a starboard side pontoon, and a third pontoon positioned between the port side pontoon and the starboard side pontoon, the at least one water inlet being positioned within the outer deck perimeter and between the port side envelope of the plurality of pontoons and the starboard side envelope of the plurality of pontoons.

20. The pontoon of claim 19, wherein the at least one water inlet is positioned in the third pontoon.

* * * * *